US006055717A

United States Patent [19]

Nakamura et al.

[11] Patent Number: 6,055,717

[45] Date of Patent: May 2, 2000

[54] SECURING METHOD OF POLYMER INSULATOR AND DIE USED FOR THIS METHOD

[75] Inventors: Itsushi Nakamura, Nagoya; Yasushi Ohkawa, Kasugai; Tomio Suzuki, Yokkaichi; Eiji Kitagami, Komaki, all of Japan

[73] Assignee: NGK Insulators, Ltd., Nagoya, Japan

[21] Appl. No.: 09/046,499

[22] Filed: Mar. 23, 1998

[30] Foreign Application Priority Data

Mar. 25, 1997 [JP] Japan ..... 9-071750

[51] Int. Cl.[7] ..... B21D 39/04

[52] U.S. Cl. ..... 29/517; 29/515; 29/516

[58] Field of Search ..... 29/515, 516, 517; 72/416

[56] References Cited

U.S. PATENT DOCUMENTS

| | | | |
|---|---|---|---|
| 650,862 | 6/1900 | McTighe . | |
| 2,327,650 | 8/1943 | Klein | 287/109 |
| 3,152,392 | 10/1964 | Coppack et al. | 29/517 |
| 3,192,622 | 7/1965 | Bannerman | 29/517 |
| 4,303,799 | 12/1981 | Ishihara et al. | 174/176 |
| 4,654,478 | 3/1987 | Ishihara et al. | 174/176 |
| 5,907,898 | 6/1999 | Kunieda et al. | 29/517 |

FOREIGN PATENT DOCUMENTS 60-54730 of 1985 Japan .

*Primary Examiner*—David P. Bryant
*Assistant Examiner*—Essama Omgba
*Attorney, Agent, or Firm*—Wall Marjama Bilinski & Burr

[57] ABSTRACT

A securing method of a polymer insulator including the steps of inserting an FRP core into a depression portion of a metal member having an open end portion, and connecting the metal member to the FRP core by compressing the FRP core and the metal member is disclosed. The improvement includes the steps of: determining a first region defining a part of a compression portion of the metal member, to which a compression pressure is applied, from a side of the open end portion; determining a second region defining the other part of the compression portion in succession with the first region; and controlling a deformation of the first region in such a manner that a deformation amount of the first region is increased gradually toward the second region.

5 Claims, 4 Drawing Sheets

SECURING METHOD OF POLYMER INSULATOR AND DIE USED FOR THIS METHOD

BACKGROUND OF THE INVENTION

1. Field of the Invention

The present invention relates to a securing method of a polymer insulator. More specifically, the present invention relates to a method of inserting a core into a depression portion of a metal member having an open end, and connecting the metal member to the core by circumferentially compressing the core and the metal member by means of a compression die. The present invention also relates to the die used for this securing method.

2. Related Art Statement

Generally, various securing methods for inserting a core into a depression portion of a metal member having an open end and connecting the metal member to the core by compressing circumferentially the core and the metal member by means of a compression die known. For example, Japanese Patent Publication No. 60-54730 (JP-B-60-54730) discloses, such a technique. As shown in FIG. 7, an FRP core 51 and a metal member 52 are connected by performing a compression operation such that a compression pressure P is circumferentially applied at once to a compression portion L of the FRP core 51 to the metal member 52 to be compressed using a compression die 53 having a width corresponding to the compression portion L. In this technique, since the metal member 52 is plastically deformed in a direction vertical to the applied compression pressure, a tensile pressure is applied to the FRP core 51 in its axial direction. Moreover, the compression pressure is simultaneously applied to the FRP core 51 in its radial direction. The resultant polymer insulator formed by the above securing method exhibits decreased strength over time due to a load-time property. This is because the FRP core 51 shows a creep. The strength decreasing rate is defined in the IEC standard, which is theoretically satisfied by the polymer insulator formed by the above securing method. However, it is desirable that the long-term strength decreasing rate deteriorates as slowly as possible to ensure that the polymer insulator is safer when used in an actual line.

Moreover, in the polymer insulator manufactured by the known securing method, a tensile stress is applied, a stress concentration occurs near the end of a compression portion L on the open end of metal member 52. When this stress is applied for a long time, the FRP core 51 will fracture. Therefore, it is necessary to eliminate the stress concentration mentioned above so as to decrease the long-term strength decreasing rate.

SUMMARY OF THE INVENTION

An object of the invention is to eliminate the drawbacks mentioned above and to provide a securing method for a polymer insulator using a die used to secure a metal fitting to an EFP rod, wherein the long-term strength decreasing rate is decreased when the FRP core and a metal member are connected using a compression die.

According to the invention, a securing method of a polymer insulator is provided including the steps of inserting an FRP core into a depression portion of a metal member having an open end portion, and connecting the metal member to the FRP core by compressing the FRP core and the metal member. This securing method comprises the steps of: determining a first region defining a part of a compression portion of the metal member, to which a compression pressure is applied, from a side of the open end portion; determining a second region defining the other part of the compression portion in succession with the first region; and controlling a deformation of the first region in such a manner that a deformation amount of the first region is increased gradually toward the second region.

Moreover, according to the invention, a die used for the securing method of a polymer insulator, comprises: a first compression surface having a first inclination with respect to a compression surface of the metal member; and a second compression surface having a second inclination different from the first inclination of the first compression surface.

In the present invention, when the FRP core is inserted into a depression portion of the metal member having the open end portion, and the metal member is connected to the FRP core by compressing the FRP core and the metal member, a deformation of the first region is controlled in such a manner that a deformation amount of the first region is increased gradually toward the second region, in which the first region defines a part of a compression portion, to which a compression pressure is applied from a side of the open end portion, and the second region defines the other part of the compression portion in succession with the first region. Therefore, it is possible to reduce a stress concentration at a side of the open end portion of the compression portion and to decrease a long-term strength decreasing rate.

DESCRIPTION OF THE PREFERRED EMBODIMENTS

Figure 1:
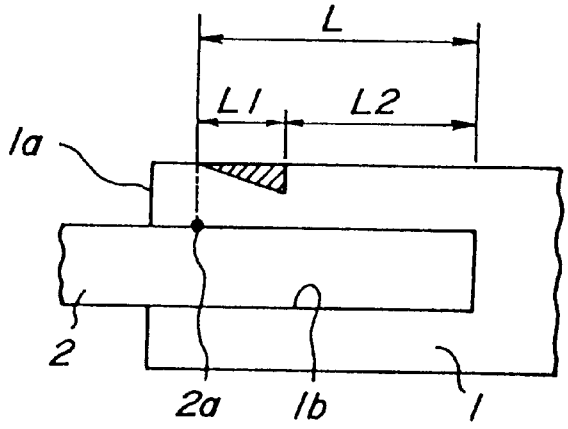
FIG. 1 is a schematic view showing one embodiment of a securing method of a polymer insulator according to the invention.

FIG. 1 is a schematic view showing one embodiment of a securing method of a polymer insulator according to the invention. In the embodiment shown in FIG. 1, an FRP core 2 is inserted into a depression portion 1*b* of a metal member 1 having an open end 1*a*, and the metal member 1 and the FRP core 2 are connected by compressing them. In the securing method of the polymer insulator according to the invention, a first region L1 is determined as defining a part of a compression portion L of the metal member 1, to which a compression pressure is applied, from a side of the open end 1*a*, and a second region L2 is determined as defining the other portion of the compression portion L in succession with the first region L1. In this case, a deformation amount of the metal member 1 corresponding to the first region L1 is made as small as possible preferably zero at an end of the first region L1 in a side of the open end 1*a*, and is increased gradually toward the second region L2. That is to say, when a compression operation is performed by using a compression die not shown, a deformation amount of the metal member 1 corresponding to the first region L1 is controlled to be shown in a hatched area in FIG. 1.

In the embodiment shown in FIG. 1, a deformation amount of the metal member 1 corresponding to the second region L2 is not shown in FIG. 1. This means that the metal member 1 corresponding to the second region L2 is also compressed by using a compression die but a deformation amount of the metal member 1 corresponding to the second region L2 can be determined arbitrarily. Moreover, in FIG. 1, a deformation amount of the metal member 1 corresponding to the first region L1 is shown only at an upper side for a convenience of drawing. However, a compression operation by means of a compression die is performed actually by compressing circumferentially all the surface of the cylindrical metal member 1. Further, in FIG. 1, a deformation amount of the metal member 1 corresponding to the first region L1 increases linearly, but it may be increased in a non-linear manner.

In this manner, if a compression operation by means of a compression die is controlled such that a deformation amount of the metal member 1 corresponding to the first region 1 is shown in a hatched area in FIG. 1, it is possible to obtain a necessary preliminarily strength, and also possible to reduce a stress concentration generated at a portion 2*a* of the FRP core 2 just under an end of the compression portion L i.e. the first region L1. As a result, it is possible to decrease a long-term strength decreasing rate of the FRP core 2 in an actual use.

Figure 2A:
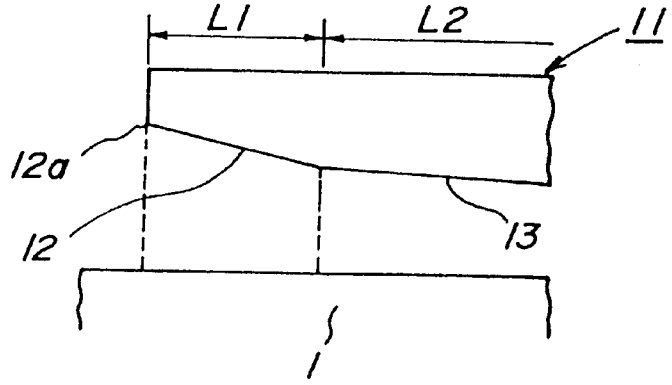
FIGS. 2*a* and 2*b* are schematic views respectively illustrating a method of achieving a deformation of the first region L1 in FIG. 1.
Figure 2B:
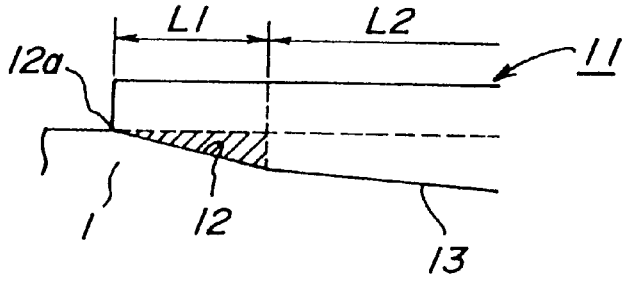

FIGS. 2*a* and 2*b* are schematic views for explaining a method of achieving a deformation with respect to the first region L1 shown in FIG. 1. In the embodiments shown in FIGS. 2*a* and 2*b*, a compression die 11 comprises a first inclination with respect to a compression surface of the metal member 1 to be compressed, and a second compression surface 13 having a second inclination other than the first inclination of the first compression surface 12. In the die 11, the first inclination of the first compression surface 12 is larger than the second surface 13. Moreover, the first inclination of the first compression surface 12 is linear, but it may be non-linear. A shape of the second inclination of the second compression surface 13 is the same as the first inclination mentioned above.

In the embodiment mentioned above, as shown in FIG. 2*b*, if the metal member 1 is compressed by the die 11, it is possible to perform the securing method according to the invention. That is to say, the securing method according to the invention can be achieved by moving the compression die 11 in such a manner that an open end portion 12*a* of the first compression surface 12 is positioned to a surface of the metal member 1, i.e. by compressing the metal member 1 in such a manner that the metal member 1 is not deformed by the open end portion 12*a* of the first compression surface 12. Moreover, in the embodiments shown in FIGS. 2*a* and 2*b*, the first compression surface 13 corresponds to the first region 11, but a positional relation therebetween is not limited in the manner mentioned above.

Figure 3:
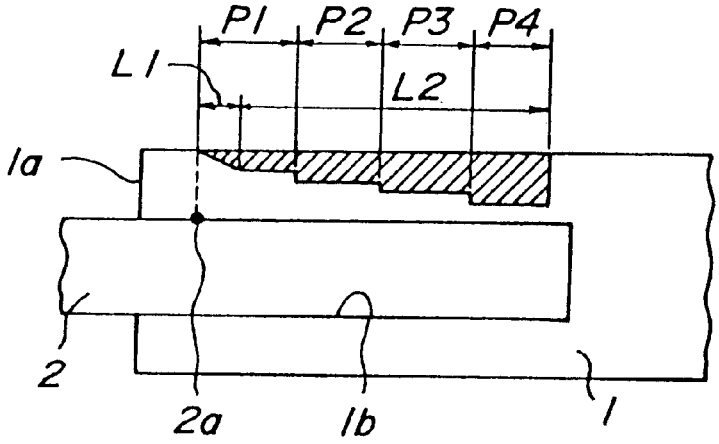
FIG. 3 is a schematic view depicting another embodiment of the securing method of the polymer insulator according to the invention.

FIG. 3 is a schematic view for explaining another embodiment of a securing method of a polymer insulator according to the invention. In the embodiment shown in FIG. 3, portions similar to those of FIG. 1 are denoted by the same reference numerals shown in FIG. 1, and the explanations thereof are omitted here. In the embodiment shown in FIG. 3, the first region L1 and a part of the second region L2 are compressed firstly by one compression operation P1. Then, the other part of the second region L2 are divided into a plurality of sub regions (here, three sub regions), and the divided sub regions are compressed successively from a side of the open end to the other end side by three compression operations P2–P4. In this case, deformation amounts of the three sub regions are successively increased from the side of the open end to the other end side in such a manner that a relation of P2<P3<P4 is satisfied. These constructions mentioned above are different from those of FIG. 1.

Therefore, in the embodiment shown in FIG. 3, as is the same as the embodiment shown in FIG. 1, it is possible to reduce a stress concentration generated at the portion 2*a* of the FRP core 2 just under the end of the first compression portion L1. In addition, it is possible to improve a securing of the metal member 1 with respect to the FRP core 2. In the embodiment shown in FIG. 3, compression operations P1–P4 are performed successively in a non-overlapped manner therebetween. However, compression operations P1–P4 mentioned above, it is possible to use two dies i.e. the die 11 shown in FIG. 2 for the compression operation P1 comprising the first compression surface 12 and the second compression surface 13 which has a little inclination with respect to a surface of the metal member 1, and a die for the compression operations P2–P4 having a compression surface parallel to a surface of the metal member 1. Moreover, if it is undesirable to increase the number of the compression dies, use is made of the die 11 having the first compression surface 12 and the second compression surface 13 which has a little inclination, and only the second compression surface 13 of the die 11 mentioned above may be used for performing the compression operations P2–P4.

Figure 4:
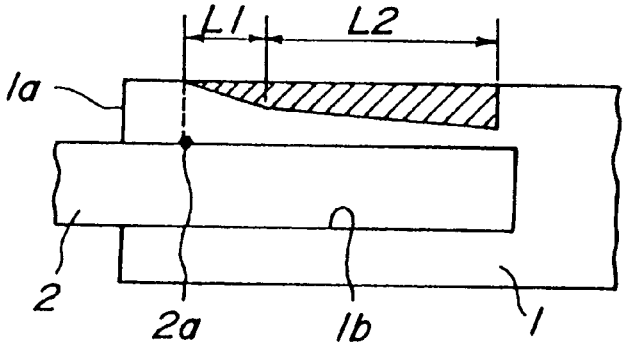
FIG. 4 is a schematic view showing still another embodiment of the securing method of the polymer insulator according to the invention.
Figure 5:
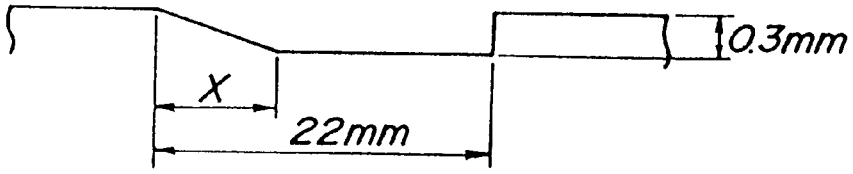
FIG. 5 is a schematic view for explaining conditions of a simulation.

FIG. 4 is a schematic view showing still another embodiment of a securing method of a polymer insulator according to the invention. In the embodiment shown in FIG. 4, a deformation amount of the second region L2 is increased linearly from one end in succession with the first region L1 to the other end therein. In this embodiment, since the maximum deformation amount is generated at the other end mentioned above, a deformation in the first region L1 and a deformation in the second region L2 are different on their inclination, but they are continued. Also in this embodiment, both of the deformation amounts of the first region L1 and the second region L2 are increased linearly, but they may be increased in non-linearly. Moreover, the deformation shown in FIG. 4 can be achieved by one compression operation by means of a compression die.

In the embodiment shown in FIG. 4, as is the same as the embodiment shown in FIG. 1, it is possible to reduce a stress concentration generated at the portion 2*a* of the FRP core 2 just under the end of the first region L1. As a die for performing the embodiment shown in FIG. 4, in the case that all the compression portion L is compressed by one compression operation, use may be made of a die having the first compressing surface 12 corresponding to the first region L1 and the second compression portion 13 corresponding to the second region L2, in which a width of the die 11 is the same as that of the compression portion L. Moreover, as is the same as the embodiment shown in FIG. 3, a compression operation may be performed by compressing the divided sub regions successively.

Figure 6:
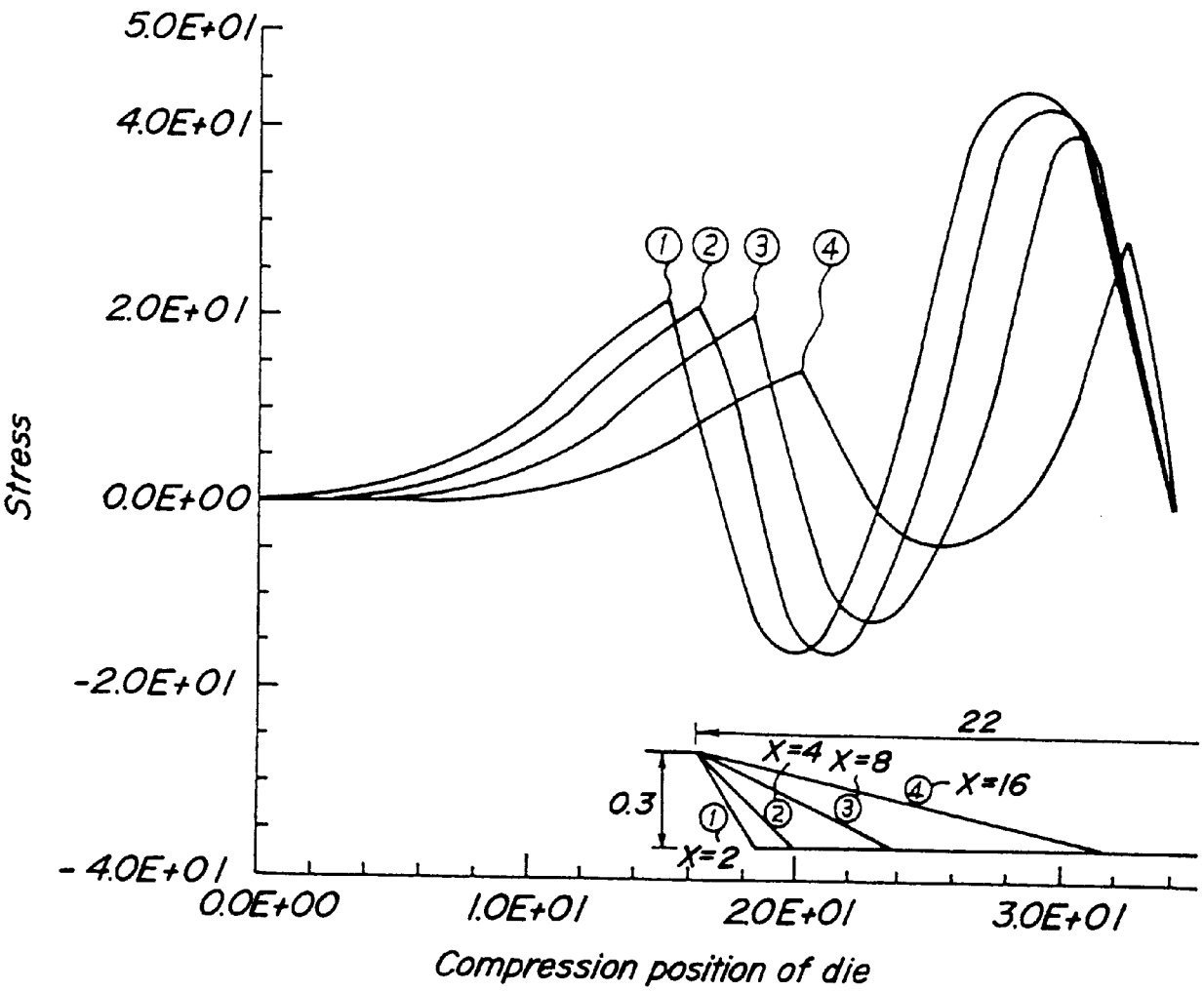
FIG. 6 is a graph illustrating a result of the simulation.
Figure 7:
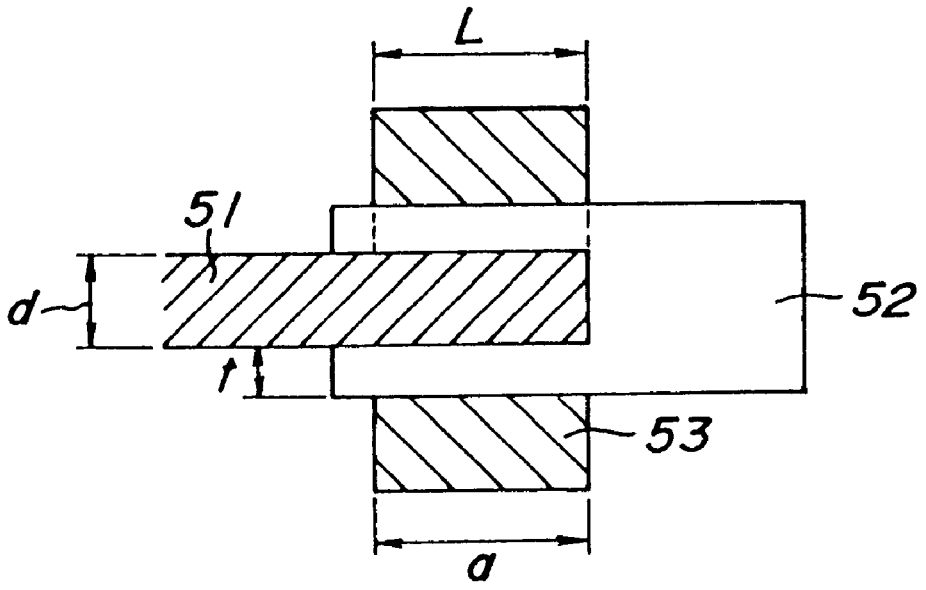
FIG 7 PRIOR ART
FIG. 7 is a schematic view depicting one embodiment of a known securing method.

Then, an effect of reducing a stress concentration generated at the portion 2*a* of the FRP core 2 just under the end of the compression portion L is simulated. Conditions of this simulation is as follows. That is to say, a deformation amount of the first region L1 is zero at the end of the compression portion L in a side of the open end. In addition, as an example of increasing gradually a deformation amount of the first region L1 toward the second region L2, in the case that a deformation having a depth of 0.3 mm is applied to the metal member 1, stresses are calculated when a length X of the first region L1 is varied to X=2, 4, 6, 16 (mm). The simulated results are shown in FIG. 6. From the results shown in FIG. 6, it is confirmed that a stress concentration generated at a portion just under or near the end of the compression portion L of the FRP core 2 is greater than 20 $kg/cm^2$ when the length X is 2, 4 or 8 (mm), and that a stress concentration is decreased to about 15 $kg/cm^2$ when the length X is 16 (mm). Therefore, it is understood that, in the present invention, it is preferred to set the length X of the first region L1 to 16 mm. Moreover, it is understood that, in all the cases, the polymer insulator has a sufficient securing force between the metal member and the FRP core. In FIG. 6, a shape of the die to be used is described therein, and a relative relation between a stress and a compression position can be understood.

As clearly understood from the above explanations, according to the invention, when the FRP core is inserted into a depression portion of the metal member having the open end portion, and the metal member is connected to the FRP core by compressing the FRP core and the metal member, a deformation of the first region is controlled in such a manner that a deformation amount of the first region is increased gradually toward the second region, in which the first region defines a part of a compression portion, to which a compression pressure is applied from a side of the open end portion, and the second region defines the other part of the compression portion in succession with the first region. Therefore, it is possible to reduce a stress concentration at a side of the open end portion of the compression portion and to decrease a long-term strength decreasing rate.

Moreover, according to the invention, since a die comprises a first compression surface having a first inclination with respect to a surface to be compressed and a second compression surface having a second inclination other than the first inclination of the first compression surface, it is possible to perform preferably the securing method mentioned above.

What is claimed is:

1. A securing method of a polymer insulator including the steps of inserting an FRP core into a depression portion of a metal member having an open end portion, and connecting the metal member to the FRP core by compressing the FRP core and the metal member, comprising the steps of:

providing a die a first compression surface having a first inclination with respect to a compression surface of the metal member, and a second compression surface having a second inclination other than the first inclination of the first compression surface;

determining a first region defining a part of a compression portion of the metal member, to which a compression pressure is applied via said first compression surface of said die, from a side of the open end portion;

determining a second region defining another part of the compression portion of the metal member, said second region being in succession with the first region; and controlling a deformation of the first region in such a manner that a deformation amount of the first region is increased gradually toward the second region.

2. The securing method according to claim 1, wherein the first region and a part of the second region are compressed firstly by one compression operation, and then the other part of the second region is divided into a plurality of sub regions and the divided sub regions are compressed successively from the open end to the other end of the metal member in such a manner that deformation amounts of the sub regions are successively increased from the open end to the other end.

3. The securing method according to claim 2, wherein the compression operations of the sub regions are performed in such a manner that compression portions of respective compression operations are overlapped partially.

4. The securing method according to claim 1, wherein an increase of the stress distribution in the first region or the second region is linear or non-linear.

5. The securing method according to claim 1, wherein the compression portion is compressed by one compression operation.

* * * * *